US006227951B1

(12) United States Patent
Fredrick

(10) Patent No.: US 6,227,951 B1
(45) Date of Patent: May 8, 2001

(54) HIGH PRESSURE GLAND NUT AND COLLAR

(75) Inventor: Joseph K. Fredrick, Buford, GA (US)

(73) Assignee: Fredrick Equipment, Inc., Buford, GA (US)

( * ) Notice: Subject to any disclaimer, the term of this patent is extended or adjusted under 35 U.S.C. 154(b) by 0 days.

(21) Appl. No.: 09/404,731

(22) Filed: Sep. 24, 1999

(51) Int. Cl.[7] ..... B24C 5/04
(52) U.S. Cl. ..... 451/102; 284/94; 284/919
(58) Field of Search ..... 451/102, 90, 101; 285/94, 919

(56) References Cited

U.S. PATENT DOCUMENTS 3,617,349 * 11/1971 Prasse ..... 117/71 M
3,632,368 * 1/1972 Nelson ..... 117/16
3,930,619 * 1/1976 Levey et al. ..... 239/526
4,555,872 * 12/1985 Yie ..... 451/102
4,758,025 7/1988 Frick .
4,765,540 * 8/1988 Yie ..... 239/8
5,253,902 10/1993 Petelot et al. .
5,280,968 1/1994 Moore et al. .
5,398,975 3/1995 Simmons .
5,496,073 3/1996 Grenier .
5,681,058 10/1997 Hwang .
5,915,402 * 6/1999 Michell, II ..... 137/15

* cited by examiner

*Primary Examiner*—Robert A. Rose

(57) ABSTRACT

A high pressure fluid transmission nozzle. The nozzle comprises a circular fluid transmitting tubing threaded in close proximity to a tubing discharge end for receiving a complementary threaded, circular collar. Overriding the tubing and collar is a circular gland nut, where the circular gland nut may include an externally threaded shank portion. The circular collar and circular gland nut are each characterized by a pair of radially aligned through holes, where a given pair are diametrically aligned to pass through the axis of the circular fluid transmitting tubing. The holes are adapted to receive a hand tool, such as a spanner tool, to disengage the collar and gland from the tubing. Further, to facilitate the disengagement, the contact engaging surfaces are impregnated with a permanent film lubricant, such as a thermosetting resin.

7 Claims, 1 Drawing Sheet

HIGH PRESSURE GLAND NUT AND COLLAR

FIELD OF THE INVENTION

This invention is directed to the field of high pressure fittings, such as the gland nut and collar components for a high pressure nozzle.

BACKGROUND OF THE INVENTION

The present invention relates to a high pressure nozzle, such as may be used in cutting or cleaning, where the nozzle features, for example, a gland nut and collar that is easily removed from the nozzle tubing. One disadvantage of prior art designs, particularly as to the collar thereof, is that conventional vice grips or channel locks are required to remove the collar from the tubing. This practice tends to distort, marr, or otherwise damage the collar and possibly the tubing upon which it is installed, particularly with improperly lubricated joints.

Several prior art designs for pipe fittings and components, which illustrate the latter problem, are described in the following U.S. Patents:

a.) U.S. Pat. No. 5,681,058, to Hwang, relates to an assembly for joining a pipe to a pipe fitting that includes an anti-leak gasket mounted around the pipe, and which has a tapered portion with an outer periphery complimentary to and thus fittingly received in a tapered inner wall section of the pipe fitting. An inner threaded ring is mounted around the pipe at a position above the anti-leak gasket and includes threads defined in an outer periphery thereof for threaded engagement with threads defined in the pipe fitting. The inner threaded ring further includes an inclined inner peripheral wall. A C-shaped ring is mounted between the inclined inner peripheral wall of the inner threaded ring and the outer periphery of the pipe. The C-shaped ring includes a plurality of first protrusions projecting from an inner periphery thereof and received in an annular groove of the pipe, and a plurality of second protrusions projecting from an outer periphery thereof. The outer periphery of each second protrusion of the C-shaped ring is a beveled surface for fittingly engaging with the inclined inner peripheral wall of the inner threaded ring. The C-shaped ring frictionally clamps the pipe upon rotation of the inner threaded ring.

b.) U.S. Pat. No. 5,496,073, to Grenier, teaches a disengagement tool for a coupling assembly including a receiving tubular member for receiving a first tubular member, the receiving tubular member having an inner portion defining an inner bore dimensioned to receive one end of the first member and an outer portion defining an internal annular cavity intersecting the inner bore and projecting radially therefrom, and a split lock ring disposed in the annular cavity and adapted to expand circumferentially therein during insertion of the first tubular member into the receiving tubular member. Forming the tool are parts with actuator end portions for engaging circumferential edge portions of the split ring and a driver portion for engaging an end thereof to facilitate axial rotation thereof on the first tubular member.

c.) U.S. Pat. No. 5,398,975, to Simmons, is directed to a tubular member in which one of the threaded connectors of the tubular member has a composite layer of carbon fiber reinforced plastic formed thereon. The body of the tubular member or pipe joint is preferably formed of a composite material such as fiberglass reinforced plastic. The connectors of tubulars members may be threaded together with a suitable thread sealant to provide a pressure tight seal in the connection. The pressure tight seal may be formed over a wide range of torque values, therefore, the tubular member may be made-up to position rather than torque to form a pressure-tight seal and without galling the threads of the connectors. The layer of carbon and resin also reduces or eliminates galling of the threads and reduces thread wear, therefore, many make-and break cycles are possible without excessive thread water.

d.) U.S. Pat. No. 5,280,968, to Moore et al., relates to a pivot pin for use in joint assemblies for ducting, and more particularly relates to pivot pins interfitting into gimbal joints used to flexibly connect sections of high pressure aircraft ducting together, so that said sections of ducting may rotate at said joints relative to each other. There is a reservoir for lubricant integrally formed in the pivot pin and located so that lubricant can seap into the bore into which the pivot pin has been inserted.

e.) U.S. Pat. No. 5,253,903, to Petelot et al., teaches an anti-seizing coating for the protection of the surfaces of male or female components of an assembly for metal tubes by threads coming into contact with one another at the time of screwing. This coating is constituted by a thin lead oxide layer produced by the oxidation of a lead layer, which is itself formed on an underlying layer of a metal such as copper and which has been directly or indirectly deposited beforehand on the surface to be protected against seizing.

f.) U.S. Pat. No. 4,758,025, to Frick, discloses a system that uses electroless metal coatings, preferably copper or zinc, on oil country tubular goods to eliminate galling of the threads, and provides for a tortuous path as a sealing surface, and porous lubricant reservoirs.

A number of the above patents relate to systems for improving lubrication of mated parts, which suggests that the respective systems are acknowledging the problem of seizing. Seizing, as known in the art, is a phenomenon where moving or sliding parts, particularly metal parts, bind or stop moving as a result of excessive pressure, temperature or friction.

Ease of lubrication, and the ability to easily disengage mated metal parts is critical for an effective fluid transmission system, such as a high pressure nozzle. None of the above patents teach ways of achieving these dual goals. In contrast, the present invention accomplishes such goals, where the manner of accomplishing same will become apparent in the description and accompanying drawings which follow.

SUMMARY OF THE INVENTION

This invention is directed to a high pressure fluid transmission nozzle of the type that may be used for cutting or cleaning, where the fluid may entrain a grit, such as silica or carbide bits, to be projected at a high velocity to the intended workpiece. The nozzle comprises a circular fluid transmitting tubing threaded in close proximity to a tubing discharge end for receiving a complementary threaded, circular collar. Further, a slidably received circular gland is positioned about the tubing and overrides the circular collar, where the circular gland may include an externally threaded shank portion. The circular collar and circular gland are each characterized by a pair of radially aligned through holes, where a given pair are diametrically aligned to pass through the axis of the circular transmitting tubing. By this arrangement, a spanner type hand tool may be used to disengage the collar and the gland from the tubing. A further feature of the nozzle is the provision of the contact engaging surfaces of the collar and gland being impregnated with a permanent dry film lubricant to facilitate the disengagement.

Accordingly, an object of this invention is a nozzle assembly, which in the operating mode is subject to extremely high pressures and the potential of seizing, but which can be readily disengaged as desired in the inoperative mode.

Another object hereof is the provision of critical supporting components having a permanent dry film lubricant impregnated into the contact surfaces for easy movement.

A further object of the invention lies in the use of a pair of opposed openings to allow access thereto by a hand tool, and thus avoid damage to the components of the nozzle assembly.

These and other objects will become more apparent to those skilled in the art from a reading of the following specification, particularly when read in conjunction with the accompanying drawings.

DETAILED DESCRIPTION OF PREFERRED EMBODIMENT

Figure 1:
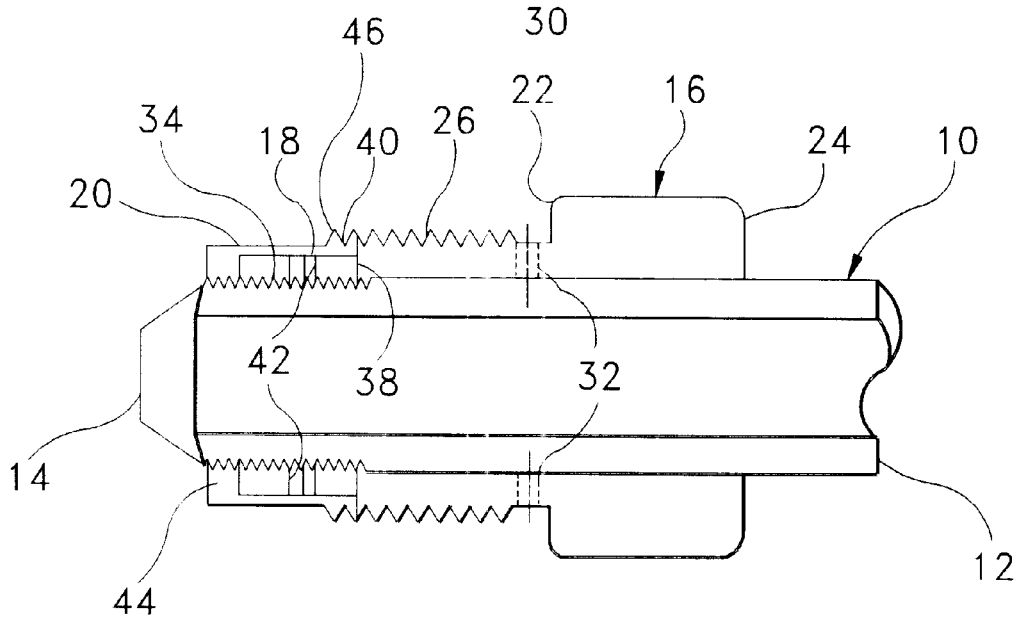
FIG. 1 is a sectional view taken axially through a nozzle assembly of this invention, illustrating a first embodiment for a medium pressure coned and threaded connection.

The present invention relates to an improved high pressure nozzle assembly of the type known as a coned and threaded connection. The high pressure coned and threaded tube connections trace their origin to the Fixed Nitrogen Research Laboratory of the U.S. Government. Developed over fifty years ago for the ammonia synthesis research program, they have been widely accepted as the primary type of connection for high pressure tubing systems.

The basic sealing principle of the high pressure connection is a narrow line contact between mating surfaces. A 58° male included cone angle is slightly smaller than the female cone angle. The initial line contact between the two cones has a small contact area. Torque applied to the gland nut produces a load, thus creating a seating stress, resulting in localized yielding and plastic flow at the contact area. The contact area broadens to an annular area seal just wide enough to support the sealing thrust, with sealing stress equal to the yield strength of the seat and cone materials. When system pressure is introduced, the resulting end load on the tube is restrained by the collar and gland nut.

Coned and threaded connection designs eliminate tube gripping and the sealing mechanics between the tube and seat. With the coned and threaded connection only one seal is required; that between the tube and the seat. Collar and tube engagement is positive with no need to generate a frictional, cutting or swaying action for end load support. The result is a higher degree of sealing and retention reliability.

A limitation of such connections lies in the difficulty of removing the collar and gland nut. The enhanced assembly of this invention will now be described with regard to the two Figures, where like reference numerals represent like components or features in the two views.

Figure 2:
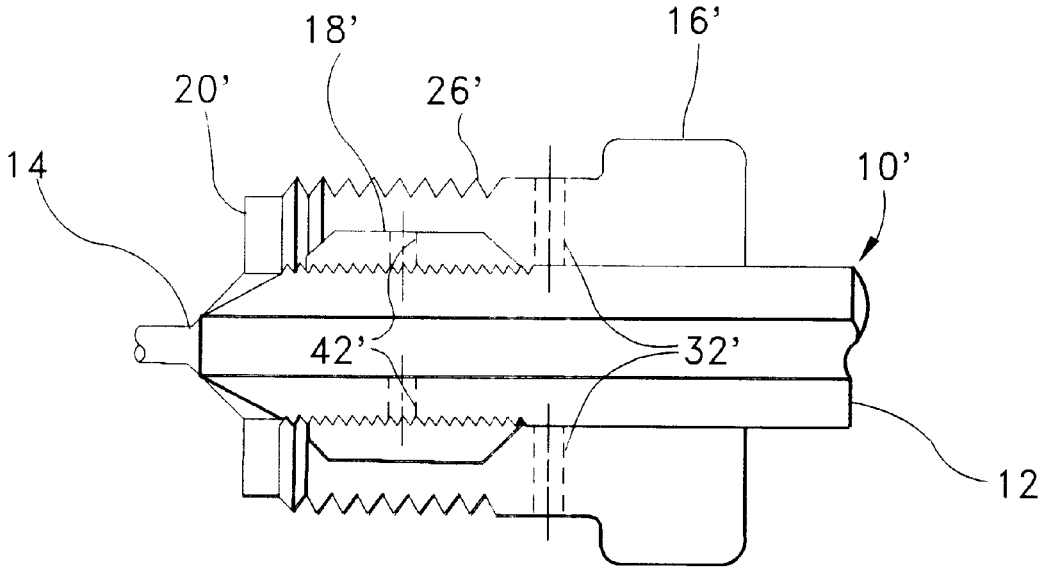
FIG. 2 is a sectional view, similar to FIG. 1, showing a high pressure coned and threaded connection.

Turning now to details of the nozzle assembly of this invention as illustrated in FIGS. 1 and 2, it will be appreciated that different applications for the nozzle assembly, such as for cleaning or cutting, can require a range of pressures. Thus, the embodiment of FIG. 1 would be used under medium pressure situations, whereas the embodiment of FIG. 2 would be for high pressure applications. However, recognizing that "medium" and "high" are relative terms, the first embodiment will be used for pressure applications up to 30K psi, while the second embodiment may be used at pressures up to 150K psi.

While there are structural differences or changed relationships for the various components of the nozzle assemblies 10, 10', respectively, of FIGS. 1 and 2, they each comprise a cold-worked metal tubing 12 for transmitting a fluid to a discharge end 14 thereof. Further, each assembly 10, 10' includes a gland nut 16, 16', a collar 18, 18', and a nozzle end 20, 20'.

Looking specifically at FIG. 1, the gland nut comprises a generally cylindrical, metal machined part 22, such as may be fabricated from 300 and 400 Series stainless steels, including precipitation hardened stainless steel like 17-4 PH, or other refractory type metals, having a large flanged head portion 24, a shank portion 26, externally threaded 28, and an intermediate shoulder portion 30, where the shoulder portion includes a pair of aligned through holes 32. As will become clearer hereafter, the radially directed holes are diametrically aligned to pass through the axis or centerline of the tubing 12.

The tubing 12 is externally threaded 34 to receive a complementary threaded, cylindrical collar 18, where the rear edge 38 is in abutting relationship to the forward edge 40 of the gland nut 16. In the manner of the gland nut 16, the collar 18, preferably fabricated of stainless steel, also features a pair of aligned, radially directed through openings 42. Finally, overriding the collar 18, in abutting relationship to forward edge 40 of the gland nut is a cylindrical valve body 44, where at least a portion of the outer surface is threaded 46 to complement and continue the threads 28.

The high pressure version of FIG. 2 features a fluid transmitting 12 that may have a thicker wall. A further difference lies in the provision of the shank portion 26' overriding and slidably engaging the underlying collar 18'. However, like its counterpart in FIG. 1, the gland nut 16' and collar 18' of the embodiment of FIG. 2 each feature a pair of aligned through openings 32', 42', respectively, which, as will be noted hereafter, allow for the easy disengagement of the components by a hand tool. A spanner type hand tool or wrench, not shown but as known in the art, comprises a hand held and manually operated tool featuring a pair of cooperating arcuate shaped arms with each having an inwardly directed pin for engaging a respective opening to manually grip and disengage the various components.

Though not illustrated in the two Figures, the respective external threads 28, 46, 28' and 46' are used to threadably engage a housing, as known in the art, where the pressurized fluid passes through a channel in the housing to exit therefrom.

Since over or under lubrication has been a problem in the past, a further feature of this invention is the treatment and use of a permanent, dry Ilim lubricant on at least the contacting surfaces of the gland nuts 16, 16' and collars 18, 18'. A preferred lubricant may be molybdenum disulfide and graphite, where a commercial solid film lubricant is sold under the trademark, LUBE-LOK 4396, by C III Corporation, a subsidiary of Great Lakes Chemical Corporation, of West Lafayette, Ind. The lubricant may be applied by spraying, dipping or a spray/tumble and cured at a temperature of about 375° F. for 1 ½ hours. This results in a nominal cured thickness of about 0.0002 to 0.0005 inches. In a preferred practice prior to treating the gland nuts and collars, the respective components are subjected to a passification treatment to develop a superficial porous layer to receive the thermosetting lubricant. Thus, the respective contacting surfaces are impregnated with the thermosetting resin resulting in a tenacious, molecularly bonded dry film thereon. This permanent lubricant ensures easy disengagement of the components.

It is recognized that variations, changes and modifications may be made to the nozzle assemblies of this invention, such as in the selection of different thermosetting resins that may be used. Accordingly, no limitation is intended to be imposed on this invention except as set forth in the following claims.

What is claimed is:

1. A high pressure fluid transmission nozzle comprising a circular fluid transmitting tubing threaded in close proximity to a tubing discharge end for receiving a complementary threaded, circular collar, and a slidably received circular gland nut about said tubing and in contact with said circular collar, where said circular gland nut includes an externally threaded shank portion, said circular collar and said circular gland nut each characterized by a.) a pair of radially aligned through holes, where a given said pair are diametrically aligned to pass through the axis of said circular fluid transmitting tubing, so as to receive a hand tool to disengage said collar and said gland from said tubing; and, b.) passified contact engaging surfaces having a superficial porous layer containing a permanent dry film lubricant therein.

2. The high pressure fluid transmission nozzle according to claim 1, wherein said circular gland nut is in overriding contact with said circular collar.

3. The high pressure fluid transmission nozzle according to claim 1, wherein said circular gland nut is in an end abutting relationship to said circular collar.

4. The high pressure fluid transmission nozzle according to claim 1, wherein said permanent dry film lubricant is a thermosetting resin.

5. The high pressure fluid transmission nozzle according to claim 4, wherein said circular collar and said circular gland nut are subjected to a passification treatment prior to the application of said thermosetting resin.

6. The high pressure fluid transmission nozzle according to claim 5, wherein said passification treatment results in porous said contacting surfaces, and that said thermosetting resin fills the pores to effect an impregnation and molecular bonding of said resin to said contacting surfaces.

7. The high pressure fluid transmission nozzle according to claim 4, wherein said thermosetting resin is a molybdenum disulfide/graphite resin.

* * * * *